US008554063B2

(12) United States Patent
Hsu

(10) Patent No.: US 8,554,063 B2
(45) Date of Patent: Oct. 8, 2013

(54) STEAM GENERATOR

(75) Inventor: Chih-Kao Hsu, Taipei (TW)

(73) Assignee: Zweita International Co., Ltd., Bandar Seri Begawan (BN)

( * ) Notice: Subject to any disclaimer, the term of this patent is extended or adjusted under 35 U.S.C. 154(b) by 671 days.

(21) Appl. No.: 12/825,219

(22) Filed: Jun. 28, 2010

(65) Prior Publication Data

US 2011/0280553 A1 Nov. 17, 2011

(30) Foreign Application Priority Data

May 17, 2010 (CN) ..... 2010 2 0192593 U

(51) Int. Cl.
*D06F 75/18* (2006.01)
*F22B 1/28* (2006.01)
*F22B 37/60* (2006.01)

(52) U.S. Cl.
USPC ..... 392/394; 392/399; 122/40

(58) Field of Classification Search
None
See application file for complete search history.

(56) References Cited

U.S. PATENT DOCUMENTS

| | | | | | |
|---|---|---|---|---|---|
| 3,854,032 | A * | 12/1974 | Cooper | 219/383 |
| 4,836,145 | A * | 6/1989 | Ronchi nee Marchesin | 122/4 A |
| 4,990,745 | A * | 2/1991 | Bayles et al. | 392/386 |
| 5,265,318 | A * | 11/1993 | Shero | 29/447 |
| 5,949,958 | A * | 9/1999 | Naperkowski et al. | 392/399 |
| 6,748,904 | B1 * | 6/2004 | Chiang | 122/40 |
| 7,577,343 | B2 * | 8/2009 | Chiang | 392/399 |
| 7,801,424 | B2 * | 9/2010 | Cheung | 392/399 |
| 2007/0223894 | A1 * | 9/2007 | Cheung | 392/405 |
| 2011/0280553 | A1 * | 11/2011 | Hsu | 392/394 |

* cited by examiner

*Primary Examiner* — Joseph M Pelham
(74) *Attorney, Agent, or Firm* — Pai Patent & Trademark Law Firm; Chao-Chang David Pai

(57) ABSTRACT

A steam generator includes a housing, a heating unit, an electrothermal unit and a one-way valve. The housing has a chamber and a water inlet. The heating unit includes a heating portion extending into the chamber. The heating portion has a first spiral channel thereon. One end of the heating portion is formed with a vaporization room and a steam outlet. The vaporization room has a second spiral channel therein to extend the time that the water and the wet steam pass through the heating unit so as to provide a complete heating and vaporizing function. Besides, by the one-way valve coupled to the water inlet, the steam generator of the present invention is simple in structure and cost-effective, providing an automatic water supply and re-heating function.

10 Claims, 9 Drawing Sheets

STEAM GENERATOR

BACKGROUND OF THE INVENTION (a) Field of the Invention

The present invention relates to a steam generator, and more particularly to a steam generator applied to an electric appliance which needs to spray steam. The steam generator is capable of totally vaporizing water to generate steam.

(b) Description of the Prior Art

A steam generator is widely used to an electric appliance, such as a steam cleaning spray gun, a steam electric iron, a steam vacuum cleaner, a steam wiper, a steam stirrer, a steam cleaning machine and so on. The size of a conventional steam generator is limited and the steam can't keep the outlet at a high temperature, resulting in wet steam. This cannot clean and disinfect and causes a second pollution due to the wet steam having moisture. Sometimes, this may damage furniture. A high temperature and moist environment will cause bacteria.

Besides, the conventional steam generator is provided with many control members at the water inlet to prevent the water from backflow, such as an electromagnetic valve, a pressure relief valve or the like. This makes the steam generator complicated and increases the cost. Furthermore, it is not easy to adjust and maintain the steam generator.

SUMMARY OF THE INVENTION

The primary object of the present invention is to provide a steam generator, which comprises a housing, a heating unit, an electrothermal unit and a one-way valve. In particular, the heating unit includes a first spiral channel and a second spiral channel to extend the time that the water passes through the heating unit and to increase the contact area of the water contact with the heating unit, such that the water can be heated and vaporized totally to generate steam.

A further object of the present invention is to provide a steam generator, which provides the one-way valve coupled to the water inlet. The one-way valve is pushed to temporarily stop the water form entering for the water to be totally vaporized to generate steam, and then the steam sprays out. After the steam is sprayed out, the inside pressure will lower and the one-way valve will be pushed away to open the water outlet again. The water automatically enters the steam generator through the water inlet. The steam generator of the present invention is simple in structure and cost-effective, providing an automatic water supply and re-heating function.

DETAILED DESCRIPTION OF THE PREFERRED EMBODIMENTS

Embodiments of the present invention will now be described, by way of example only, with reference to the accompanying drawings.

Figure 1:
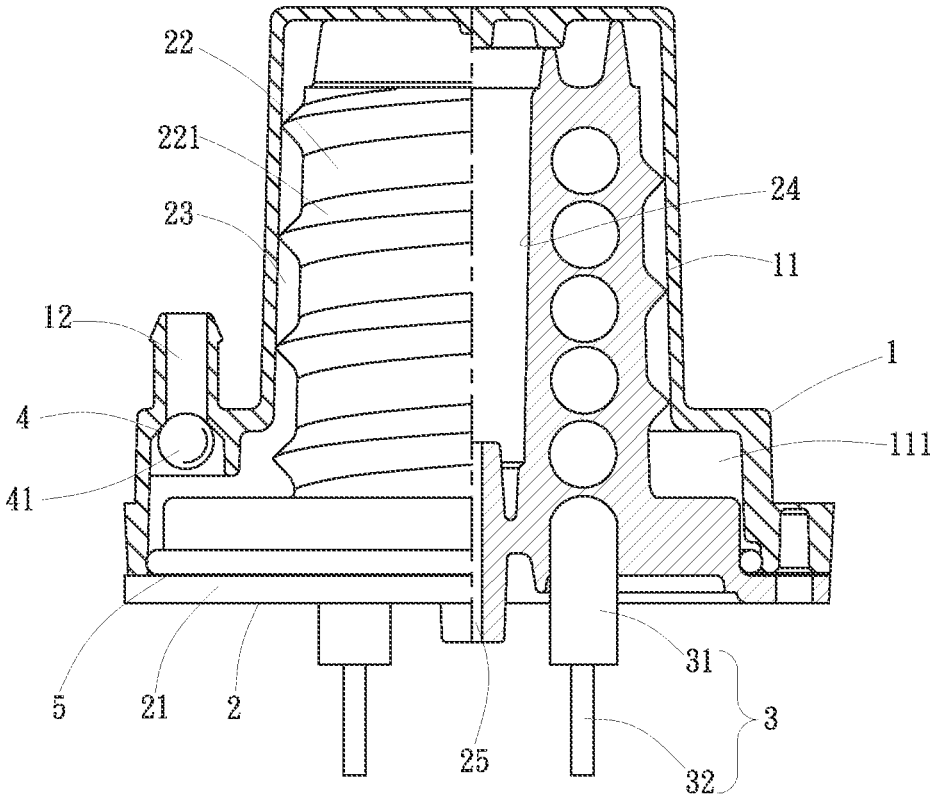
FIG. 1 is a cross-sectional view according to a preferred embodiment of the present invention.
Figure 2:
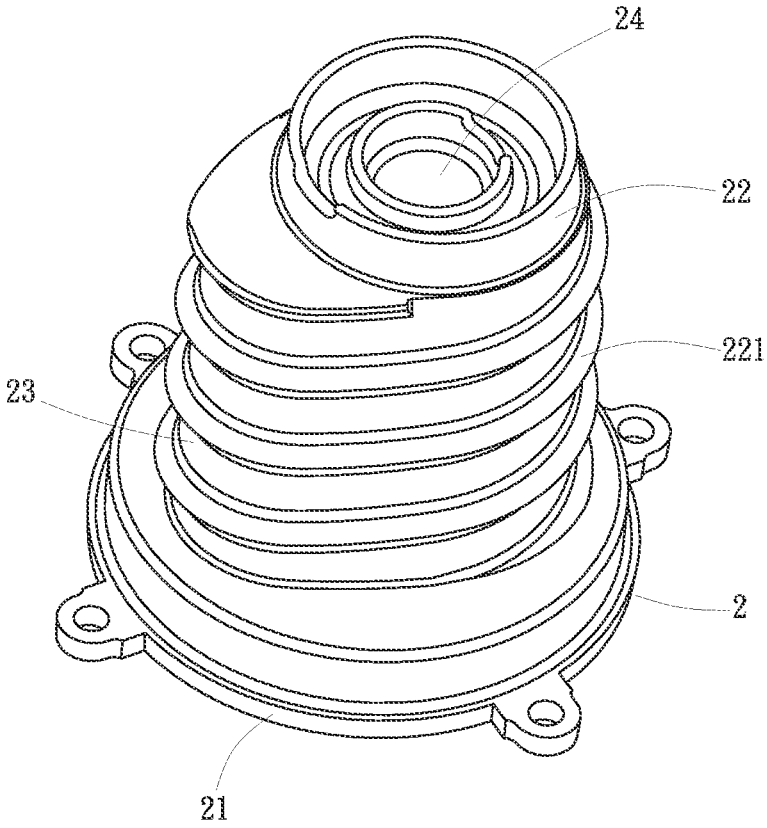
FIG. 2 is a perspective view of the heating unit according to the preferred embodiment of the present invention.
Figure 3:
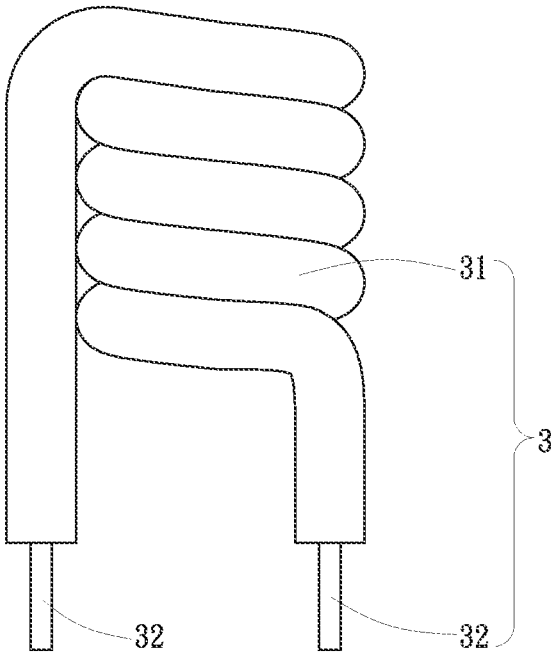
FIG. 3 is a schematic view of the electrothermal unit according to the preferred embodiment of the present invention.

As show in FIG. 1 to FIG. 3, the steam generator according to a preferred embodiment of the present invention comprises a housing 1, a heating unit 2, an electrothermal unit 3 and a one-way valve 4.

The housing 1 is a cylindrical or other shape configuration. The housing 1 comprises a chamber 11 at one end and a water inlet 12 at one side of the housing 1. The water inlet 12 communicates with the chamber 11.

The heating unit 2 is made of a heat conduction metallic material. The heating unit 2 comprises an end cap 21 and a cylindrical heating portion 22. The end cap 21 is to seal an open end of the chamber 11 of the housing 1. The heating portion 22 is located in the chamber 11. The heating portion 22 has a first spiral ring 221 formed on an outer wall of the heating portion 22. An outer circumferential portion of the first spiral ring 221 is against an inner wall of the chamber 11 to form a first spiral channel 23 in the chamber 11 to flow liquid (water) and steam. One end of the heating portion 22 is formed with a central vaporization room 24 which communicates with the first spiral channel 23. A bottom end of the vaporization room 24 has a steam outlet 25 to communicate with the outside of the end cap 21.

The electrothermal unit 3 is an electronic member which can generate thermal energy after being electrified. The electrothermal unit 3 is embedded (precast) in the heating portion 22 of the heating unit 2, so that the thermal energy can be transmitted to the entire heating portion 22 to heat the liquid (water) passing through the first spiral channel 23.

The one-way valve 4 is connected to the water inlet 12 of the housing 1 for controlling the water to enter the chamber 11. Thus the steam generator applied to an electric appliance which needs to spray steam is assembled.

As shown in FIG. 1, the housing 1 further has a water storing room 111 which is located adjacent to the open end of the chamber 11 and has a larger diameter than that of the chamber 11. The water inlet 12 communicates with the water storing room 111, such that the water from the water inlet 12 is first stored in the water storing room 111. As shown in FIG. 3, the electrothermal unit 3 is precast in the heating unit 2 and comprises an electrothermal pipe 31 and two conductive terminals 32. The electrothermal pipe 31 is spiraled in the heating portion 22 and the two conductive terminals 32 are coupled to two ends of the electrothermal pipe 31, such that the spiral electrothermal pipe 31 will generate thermal energy to heat the heating portion 22 when the two conductive terminals 32 are electrified. The water in the first spiral channel 23 will be heated and vaporized to generate steam. Preferably, the one-way valve 4 comprises a valve body 41 which is located in the chamber 11 and is against the water inlet 12. The valve body 41 can be a steel ball. The valve body 41 is controlled by the steam pressure in the chamber 11. The end cap 21 of the heating unit 2 can be sealed with a sealing ring 5 to prevent steam leakage.

Figure 4:
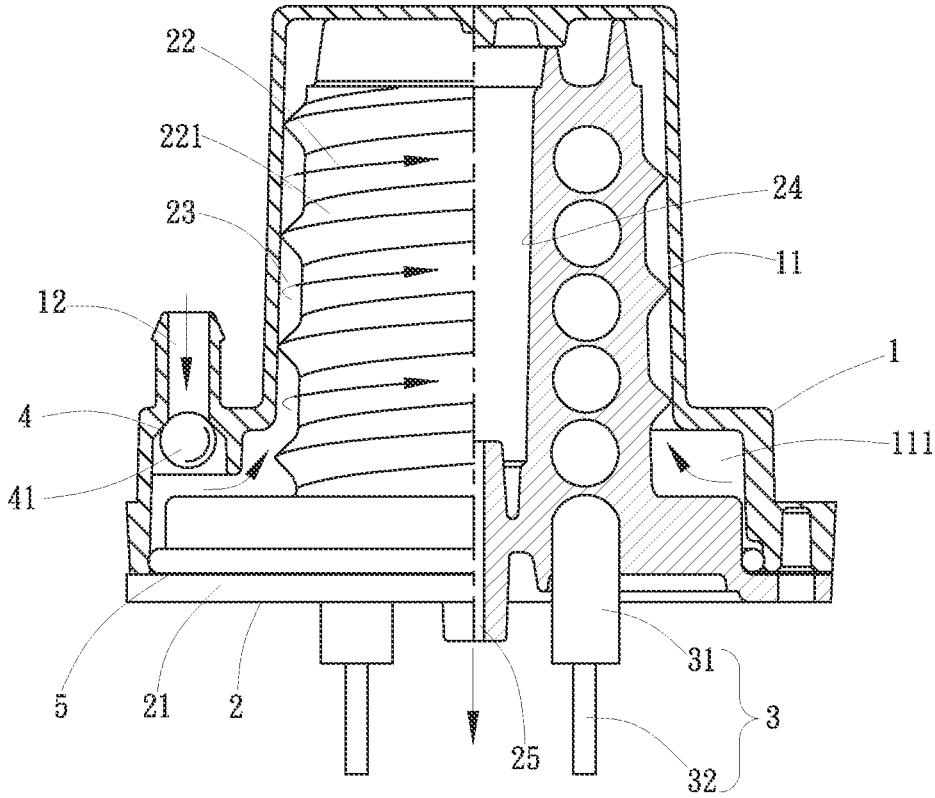
FIG. 4 is a schematic view of the steam generator according to the preferred embodiment of the present invention when in use.

The present invention can be installed in an electric appliance which needs steam. External water flows into the chamber 11 through the water inlet 12 of the housing 1 and the one-way valve 4 to be heated and vaporized for generating steam. As shown in FIG. 4, the principle of the present invention is that the external water from the water inlet 12 enters the chamber 11 to pass through the first spiral channel 23 around the heating portion 22 and the electrothermal unit 3 is controlled to heat. With the configuration of the first spiral channel 23 to increase the flowing time and contact area, the water can be vaporized to generate steam by the heating portion 22. The steam enters the vaporization room 24, and then sprays out from the steam outlet 25. The present invention may be provided with a pump (a manual pump or a power-driven pump) at the water inlet 12 to limit the water entering the chamber 11 to be a low flow. Accordingly, the water in the first spiral channel 23 can be completely heated and vaporized by the heating portion 22 to generate steam without moisture. The steam sprays out from the steam outlet 25 for the need of the electric appliance. Thus, the present invention can vaporize the water totally to generate steam.

Figure 5:
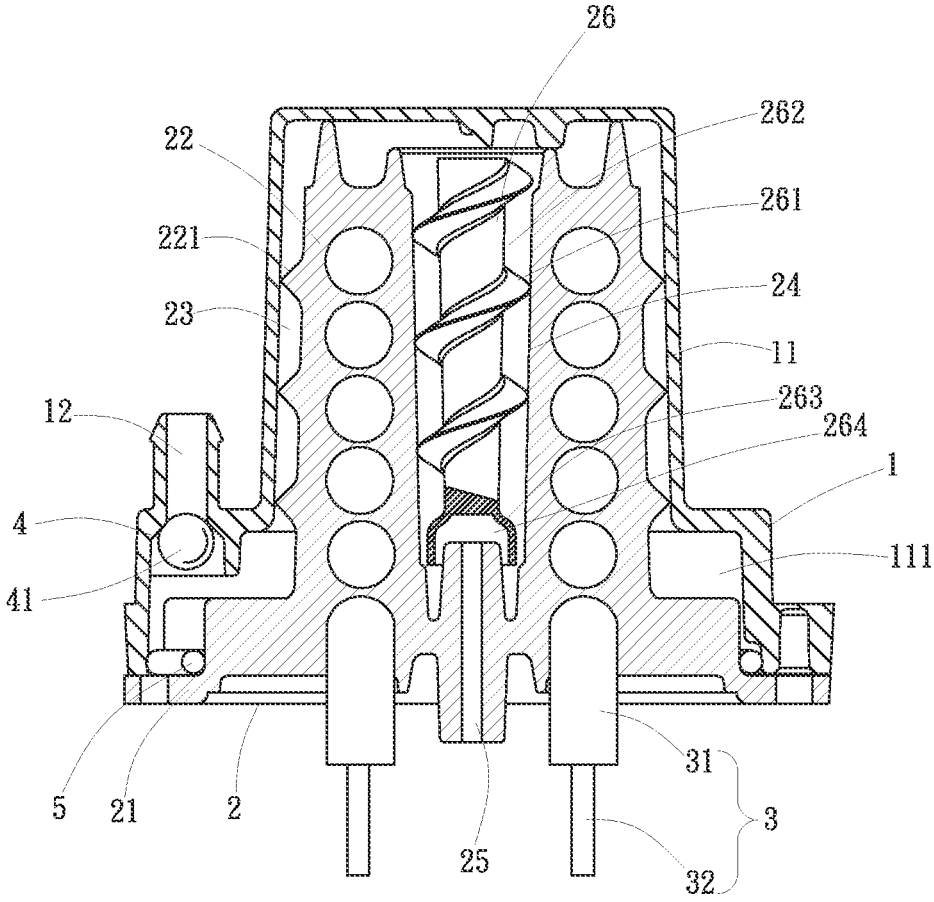
FIG. 5 is a cross-sectional view of the spiral post according to the preferred embodiment of the present invention.
Figure 7:
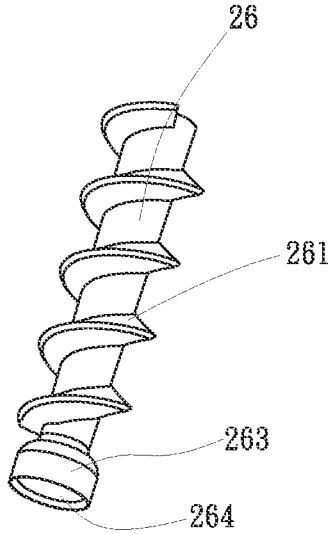
FIG. 7 is a first schematic view of the spiral post according to the preferred embodiment of the present invention.
Figure 6:
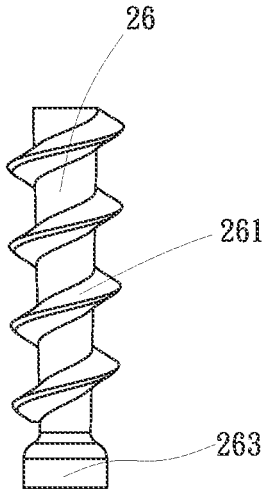
FIG. 6 is a perspective view of the spiral post according to the preferred embodiment of the present invention.
Figure 8:
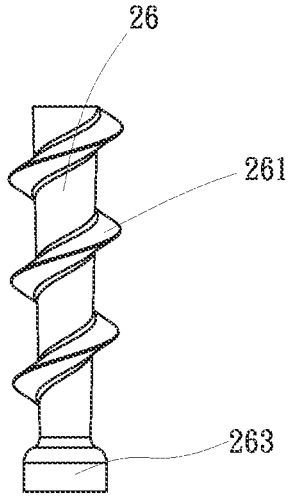
FIG. 8 is a second schematic view of the spiral post according to the preferred embodiment of the present invention.
Figure 9:
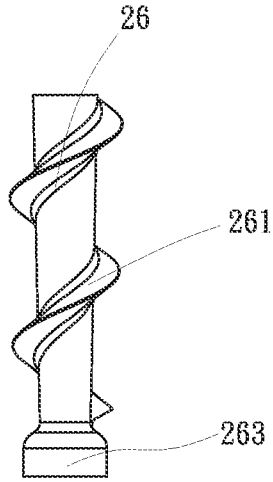
FIG. 9 is a third schematic view of the spiral post according to the preferred embodiment of the present invention.

In order to provide more steam, the pump controls the water entering the chamber 11 to be a high flow, and the time and area of the water contact with the heating portion 22 must be increased. As shown in FIG. 5 and FIG. 6, the present invention further comprises a spiral post 26 in the vaporization room 24 of the heating unit 2. The spiral post 26 has a second spiral ring 261 around an outer wall thereof. An outer circumferential portion of the second spiral ring 261 is against an inner wall of the vaporization room 24 to form a second spiral channel 262. One end of the spiral post 26 is provided with a cap 263 which is located close to the vaporization outlet 25 and has a diameter larger than that of the spiral post 26 as well as that of the steam outlet 25. The cap 263 has a hole 264 to cover the steam outlet, but not sealing the steam outlet 25, so as to increase the flowing time and contact area of the steam in the vaporization room 24. As shown in FIG. 7 to FIG. 9, the configuration of the second spiral ring 261 can be changed to adjust the flowing distance of the second spiral channel 262.

Figure 10:
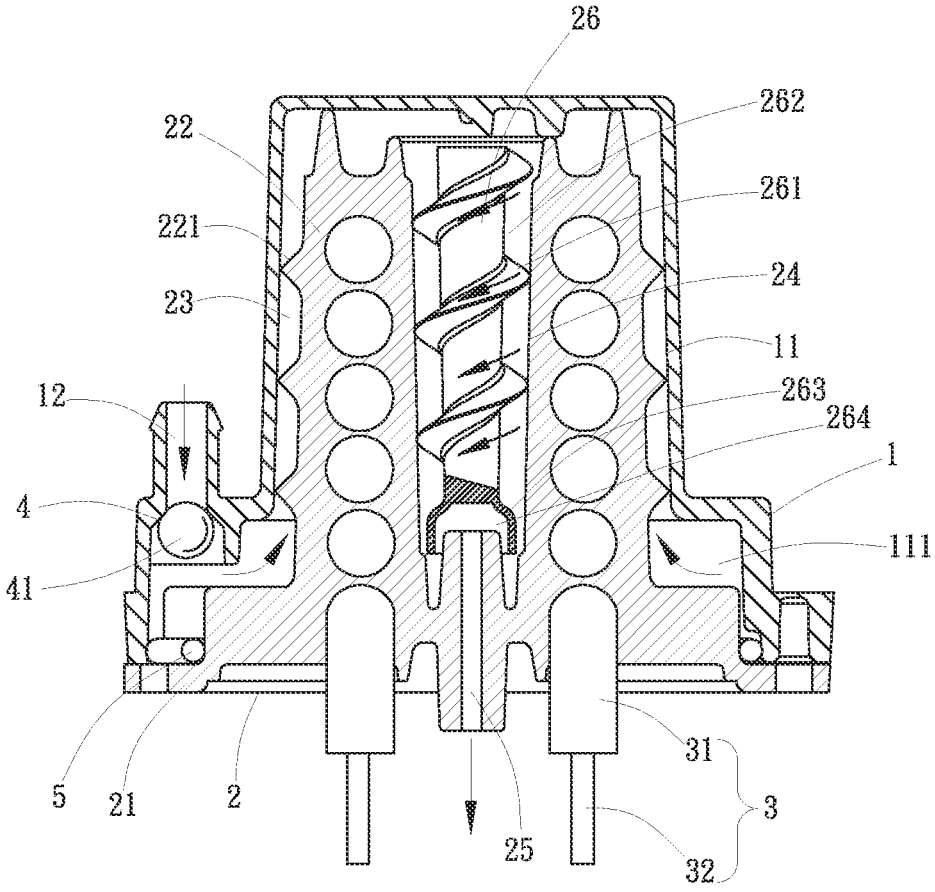
FIG. 10 is a schematic view of the spiral post according to the preferred embodiment of the present invention when in use.
Figure 11:
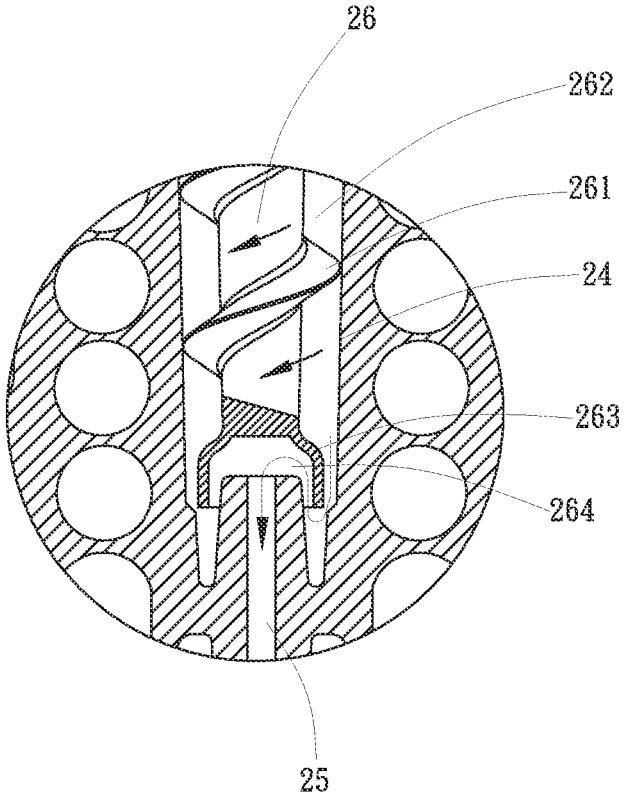
FIG. 11 is an enlarged view of the cap according to the preferred embodiment of the present invention when in use.

FIG. 10 is a schematic view to show the spiral post 26, the second spiral ring 261 and the second spiral channel 262 when in use. In the same way, the water enters the chamber 11 and passes through the first spiral channel 23 of the heating portion 22 to be heated and vaporized to generate steam which then enters the vaporization room 24. Because the water flow is greater, the steam in the vaporization room 24 may be wet steam composed of steam and moisture. The wet steam in the vaporization room 24 is pushed to the center of the heating portion 22 (in the vaporization room 24), and flows through the second spiral channel 262 toward the steam outlet 25, such that the wet steam is vaporized again to be the steam without moister. The steam at a high temperature passes the hole 264 of the cap 263 and sprays out from the steam outlet 25. Thus, the present invention not only increases the heating and vaporizing time and the heating area of the water and the wet steam in the steam generator but also reduces its size by placing the spiral post 26 in the center of the heating unit 2, avoiding the steam generator in a large size.

As shown in FIG. 4 and FIG. 10, when the water is heated and vaporized in the first spiral channel 23 to generate a pressure greater than the water pressure of the water inlet 12 of the housing 1, the valve body 41 of the one-way valve 4 will be pushed to block the water inlet 12 to temporarily stop the water form entering. Therefore, the water in the first spiral channel 23 (and the second spiral channel 262) can be totally vaporized to generate steam, and then the steam sprays out from the steam outlet 25. After the steam is sprayed out, the pressure in the chamber 11 will lower and the valve body 41 of the one-way valve 4 will be pushed away by the external water. The water enters the chamber 11 again to provide a continuous water supply and re-heating function. Besides, the one-way valve 4 is controlled by the steam pressure to achieve the aforesaid function, without a conventional electromagnetic valve which is complicated. The present invention is simple in structure and cost-effective.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A steam generator, comprising:

a housing, the housing comprising a chamber at one end thereof and a water inlet at one side thereof, the water inlet communicating with the chamber;

a heating unit, the heating unit comprising an end cap and a heating portion, the end cap being to seal an open end of the chamber of the housing, the heating portion extending into the chamber, the heating portion having a first spiral ring formed on an outer wall thereof, an outer circumferential portion of the first spiral ring being against an inner wall of the chamber to form a first spiral channel in the chamber, one end of the heating portion being formed with a vaporization room which communicates with the first spiral channel, the vaporization room having a steam outlet to communicate with outside;

an electrothermal unit, the electrothermal unit being an electronic member capable of generating thermal energy after being electrified, the electrothermal unit being embedded in the heating portion of the heating unit; and a one-way valve, the one-way valve being connected to the water inlet of the housing, wherein the housing further has a water storing room which is located adjacent to the open end of the chamber and has a larger diameter than that of the chamber, the water inlet communicating with the water storing room.

2. The steam generator as claimed in claim 1, wherein the electrothermal unit is precast in the heating portion of the heating unit.

3. The steam generator as claimed in claim 1, wherein the one-way valve comprises a valve body which is located in the chamber and is against the water inlet.

4. The steam generator as claimed in claim 1, wherein the end cap is provided with a sealing ring.

5. A steam generator, comprising:

a housing, the housing comprising a chamber at one end thereof and a water inlet at one side thereof, the water inlet communicating with the chamber;

a heating unit, the heating unit comprising an end cap and a heating portion, the end cap being to seal an open end of the chamber of the housing, the heating portion extending into the chamber, the heating portion having a first spiral ring formed on an outer wall thereof, an outer circumferential portion of the first spiral ring being against an inner wall of the chamber to form a first spiral channel in the chamber, one end of the heating portion being formed with a vaporization room which communicates with the first spiral channel, the vaporization room having a steam outlet to communicate with outside;

an electrothermal unit, the electrothermal unit being an electronic member capable of generating thermal energy after being electrified, the electrothermal unit being embedded in the heating portion of the heating unit;

a one-way valve, the one-way valve being connected to the water inlet of the housing, and a spiral post in the vaporization room of the heating unit, the spiral post having a second spiral ring formed on an outer wall thereof, an outer circumferential portion of the second spiral ring being against an inner wall of the vaporization room to form a second spiral channel.

6. The steam generator as claimed in claim 5, wherein one end of the spiral post is provided with a cap which is located close to the vaporization outlet and has a diameter larger than that of the spiral post and that of the steam outlet, the cap having a hole to cover the steam outlet, but not sealing the steam outlet.

7. The steam generator as claimed in claim 5, wherein the housing further has a water storing room which is located adjacent to the open end of the chamber and has a larger diameter than that of the chamber, the water inlet communicating with the water storing room.

8. The steam generator as claimed in claim 5, wherein the electrothermal unit is precast in the heating portion of the heating unit.

9. The steam generator as claimed in claim 5, wherein the one-way valve comprises a valve body which is located in the chamber and is against the water inlet.

10. The steam generator as claimed in claim 5, wherein the end cap is provided with a sealing ring.

* * * * *